US010167094B2

(12) United States Patent
Lamp et al.

(10) Patent No.: US 10,167,094 B2
(45) Date of Patent: Jan. 1, 2019

(54) METHOD AND APPARATUS FOR MAKING A FILLED SACHET

(71) Applicant: Designed by M.E., LLC, Bellevue, WA (US)

(72) Inventors: Tami Deanna Lamp, Bellevue, WA (US); Chérie Liana Schaible, Mamaroneck, NY (US); Stephen John Gaynes, McHenry, IL (US); Timothy James Morton, Austin, TX (US)

(73) Assignee: DESIGNED BY M.E., LLC, Bellevue, WA (US)

( * ) Notice: Subject to any disclaimer, the term of this patent is extended or adjusted under 35 U.S.C. 154(b) by 910 days.

(21) Appl. No.: 14/206,576

(22) Filed: Mar. 12, 2014

(65) Prior Publication Data

US 2014/0260108 A1 Sep. 18, 2014

Related U.S. Application Data

(60) Provisional application No. 61/790,091, filed on Mar. 15, 2013, provisional application No. 61/876,570, filed on Sep. 11, 2013.

(51) Int. Cl.
*B65B 1/06* (2006.01)
*B65B 29/02* (2006.01)
(Continued)

(52) U.S. Cl.
CPC ..... *B65B 1/06* (2013.01); *B65B 1/36* (2013.01); *B65B 7/02* (2013.01); *B65B 29/02* (2013.01); *B65B 51/146* (2013.01); *B65B 51/148* (2013.01)

(58) Field of Classification Search
CPC ..... B65B 29/02; B65B 1/06; B65B 51/14; B65B 51/142; B65B 51/146; B65B 9/10;
(Continued)

(56) References Cited

U.S. PATENT DOCUMENTS 1,659,559 A * 2/1928 Bates ..... B65B 9/15 112/11
1,686,787 A * 10/1928 Bates ..... B65B 9/15 141/145
(Continued)

FOREIGN PATENT DOCUMENTS

JP 10114307 A 5/1998
JP 2004026308 A 1/2004
(Continued)

OTHER PUBLICATIONS

PCT International Search Report and Written Opinion for application No. PCT/US2014/022496 dated Jul. 9, 2014, 12 Pages.
(Continued)

*Primary Examiner* — Stephen F Gerrity
*Assistant Examiner* — Joshua Kotis
(74) *Attorney, Agent, or Firm* — Moser Taboada

(57) ABSTRACT

Method and apparatus for making a filled sachet are disclosed. The apparatus comprises a downtube for delivering a content into an end portion of a sock, a sealer positioned proximate to the downtube for sealing the sock at a first seal position such that the content is confined between the first seal position and the end portion of the sock, and a separator positioned proximate to the downtube for separating the sealed portion of the sock from the sock.

18 Claims, 8 Drawing Sheets

(51) Int. Cl.
*B65B 1/36* (2006.01)
*B65B 51/14* (2006.01)
*B65B 7/02* (2006.01)

(58) Field of Classification Search
CPC .... B65B 9/12; B65B 9/13; B65B 9/15; B65B 7/02; B65B 1/30; B65B 1/36; B65B 1/363; B65B 1/366; B65B 1/04; B65B 9/18
USPC ..... 53/551, 552, 451, 469, 477, 479, 459, 53/567, 574–577
See application file for complete search history.

(56) References Cited

U.S. PATENT DOCUMENTS 1,879,794 A * 9/1932 Cundall ..... B65B 1/36 141/183
2,348,201 A * 5/1944 Barnett ..... B29C 65/18 493/228
2,362,460 A * 11/1944 Barnett ..... B65B 29/02 426/394
2,413,686 A * 1/1947 Barnett ..... B65B 29/02 156/217
2,969,628 A * 1/1961 Irmscher ..... B65B 1/36 53/451
2,999,532 A * 9/1961 Bursak ..... B65B 9/12 156/510
3,118,575 A * 1/1964 McCauley ..... A01K 5/0275 222/349
3,238,692 A * 3/1966 Montuori ..... B65B 9/12 53/451
3,482,373 A * 12/1969 Morris ..... B65B 1/36 206/436
3,874,976 A * 4/1975 MacFarland, Jr. ..... B29C 65/7451 156/251
3,925,139 A * 12/1975 Simmons ..... B29C 65/18 156/358
4,004,399 A * 1/1977 Borrello ..... B29C 65/18 222/368
4,088,264 A 5/1978 Vogt
4,117,647 A * 10/1978 Rossi ..... B65B 9/20 177/60
4,417,433 A * 11/1983 Mitchell ..... B65D 85/808 206/5
4,442,656 A * 4/1984 Wylie, Sr. ..... B65B 9/2014 53/552
4,446,677 A * 5/1984 Kokido ..... B65B 51/065 53/552
4,844,291 A * 7/1989 Fuss ..... B65D 90/62 222/470
4,965,986 A * 10/1990 Klinkel ..... B65B 9/2028 53/389.5
5,279,098 A * 1/1994 Fukuda ..... B29C 66/8223 53/374.6
5,284,002 A * 2/1994 Fowler ..... B29C 65/38 493/194
5,313,766 A * 5/1994 Rimondi ..... B29C 65/229 53/245
5,732,532 A * 3/1998 Fujisaki ..... B65B 9/213 141/10
5,782,067 A * 7/1998 Fuss ..... B65B 9/15 53/137.2
6,119,740 A * 9/2000 Wilham, Jr. ..... B65B 1/06 141/313
6,311,745 B1 * 11/2001 Welch ..... B65B 1/16 137/614
6,367,230 B1 * 4/2002 Fukuda ..... B29C 65/18 53/451
6,553,744 B1 * 4/2003 Terminella ..... B65B 9/20 53/551
6,560,948 B1 * 5/2003 Fuss ..... B65B 9/15 53/459
7,062,892 B2 * 6/2006 Metzger ..... B65B 1/36 53/127
7,421,834 B1 * 9/2008 Doolan ..... B65B 1/366 222/367
8,689,531 B2 * 4/2014 Miyazaki ..... B29C 66/8246 53/370.7
2003/0205035 A1 * 11/2003 Bussey, Jr. ..... B65B 9/18 53/576
2005/0109452 A1 5/2005 Basque
2006/0283149 A1 12/2006 Passini
2007/0034339 A1 2/2007 Basque et al.
2007/0186509 A1 * 8/2007 Ou ..... B29C 65/18 53/374.9
2007/0199282 A1 8/2007 Hashiba et al.
2007/0294982 A1 * 12/2007 Knoke ..... B65B 1/36 53/451
2010/0071806 A1 * 3/2010 England ..... B65B 67/12 141/313
2010/0107570 A1 * 5/2010 Khan ..... B65B 9/18 53/479
2011/0005172 A1 * 1/2011 Miyahara ..... B65B 29/02 53/455
2011/0154783 A1 * 6/2011 Bierschenk ..... B65B 1/22 53/436
2013/0045848 A1 * 2/2013 Rea ..... B65B 9/20 493/267
2014/0260121 A1 * 9/2014 Tokuda ..... B65B 29/04 53/548

FOREIGN PATENT DOCUMENTS

WO WO 2012/107867 A2 8/2012
WO WO 2012113602 A1 * 8/2012 ..... B65D 75/46

OTHER PUBLICATIONS

Portable food sealer machine from AliExpress.com UnBoxing, downloaded from https://www.youtube.com/watch?v=mpGztD-dTyrE, on Dec. 19, 2017, 2pgs.
Foil Sealer Machine from AliExpress.com Unboxing, downloaded from: https://www.youtube.com/watch?v=u5Jqu21Cm10, on Dec. 19, 2017, 2 pgs.

* cited by examiner

METHOD AND APPARATUS FOR MAKING A FILLED SACHET

CROSS-REFERENCES TO RELATED APPLICATIONS

This application claims priority to the U.S. Provisional Application No. 61/790,091 titled "METHOD AND APPARATUS FOR MAKING FILLED SACHETS" filed on Mar. 15, 2013, and the U.S. Provisional Application No. 61/876,570 titled "METHOD AND APPARATUS FOR MAKING FILLED SACHETS" filed on Sep. 11, 2013, and the entire contents of all of the aforementioned applications are hereby incorporated by reference in their entireties.

BACKGROUND

Field

Embodiments of the present invention generally relate to sachets filled with content and, more particularly, to a method and apparatus for making a filled sachet.

Description of the Related Art

Sachets are small permeable bags having enclosed contents, and are used for a variety of applications. For example, porous sachets filled with scented material, such as potpourri, are used for scenting rooms, drawers or closets. In other examples, sachets filled with beverage materials are steeped in hot liquids to prepare the beverage, such as tea bags used for dipping in hot water to prepare tea for drinking. Currently, consumers choose from a variety of pre-packaged sachets with different content, but the consumers have no direct control over the contents of the sachet, the size of the sachet.

For example, a wide variety of pre-packaged tea bags are available for purchase, but some consumers may prefer a particular blend of tea not readily available in prepackaged bags. Conventional equipment for making such sachets includes industrial tea-bag manufacturing machines that are large and expensive. Such machines typically process a large volume of content at a given time, and are therefore ill-suited for the direct use by most consumers of such pre-packaged tea bags, or for the purpose of making a small number of custom filled sachets. Currently, in order to create their own desired blend of drinking tea, consumers use an infuser such as a tea ball or a tea filter. Such infusers, require loose tea leaves to be loaded into the diffuser, and used wet tea leaves need to be removed from the diffuser. The process frequently results in particles of tea leaves remaining in the cup of tea. Further, such diffusers must be filled and emptied for each desired cup or pot of tea, and therefore need to be cleaned frequently, which is often messy and inconvenient. Some conventional techniques for making sachets require individual sachets to be filled manually, which is a difficult and cumbersome process for a user. According to such techniques, the user is further required to fold the sachet to close the top of the sachet. Sachets produced using such techniques may be inconvenient to use, because any error in the folding process may release of loose tea leaves into the beverage.

The convenience of being able to use sachet bags with custom content, of desired size or in desired quantity, especially for a domestic user is missing in the art. Therefore, there exists a need for a method and apparatus for making a filled sachet.

SUMMARY

An apparatus for making a filled sachet is provided, as set forth more completely in the claims.

These and other features and advantages of the present disclosure may be appreciated from a review of the following detailed description of the present disclosure, along with the accompanying figures in which like reference numerals refer to like parts throughout.

Figure 1:
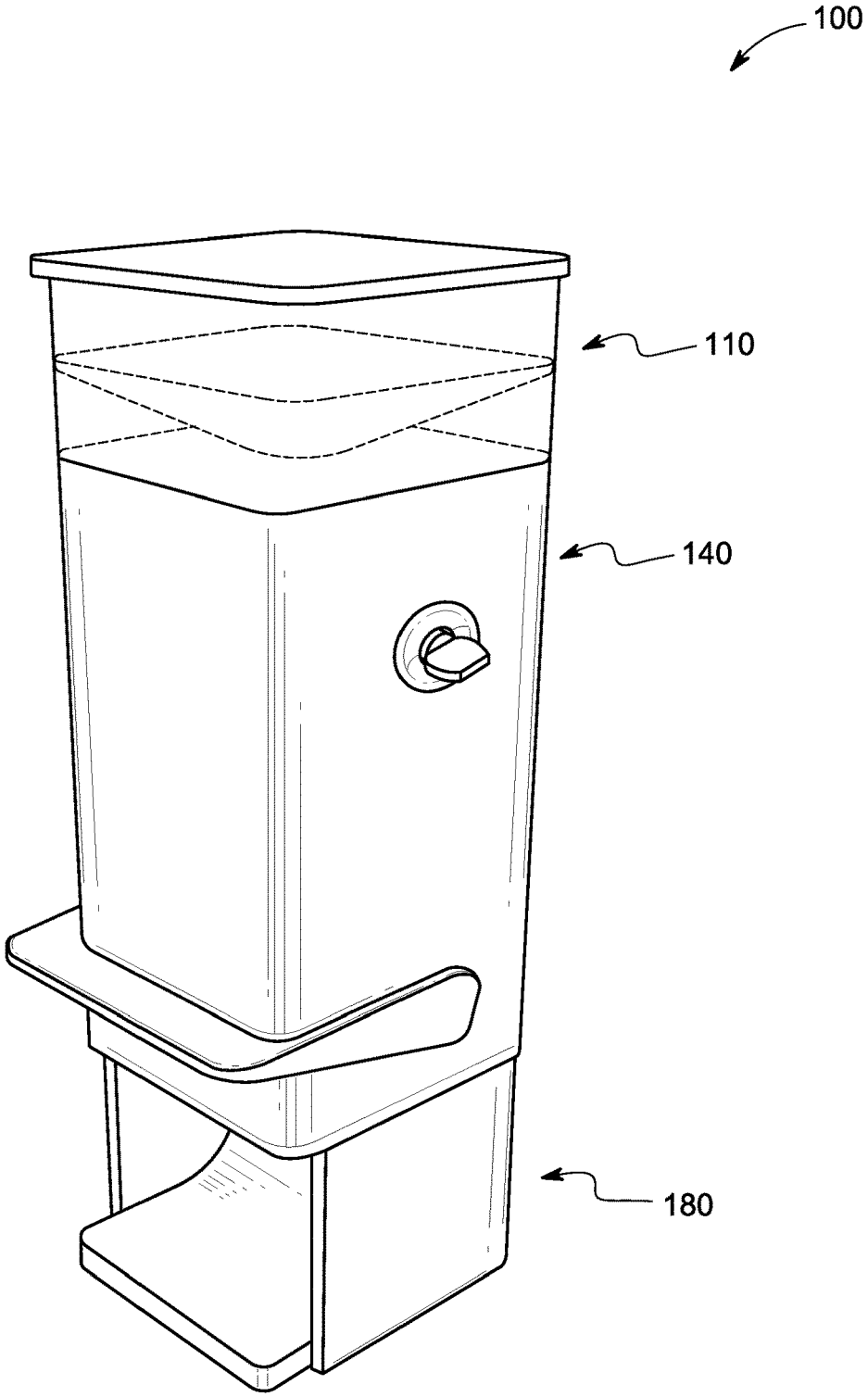
FIG. 1 depicts a perspective view of an apparatus for making a filled sachet, according to one or more embodiments.

While the method and apparatus is described herein by way of example for several embodiments and illustrative drawings, those skilled in the art will recognize that the method and apparatus for making a filled sachet is not limited to the embodiments or drawings described. It should be understood, that the drawings and detailed description thereto are not intended to limit embodiments to the particular form disclosed. Rather, the intention is to cover all modifications, equivalents and alternatives falling within the spirit and scope of the method and apparatus for making a filled sachet defined by the appended claims. Any headings used herein are for organizational purposes only and are not meant to limit the scope of the description or the claims. As used herein, the word "may" is used in a permissive sense (i.e., meaning having the potential to), rather than the mandatory sense (i.e., meaning must). Similarly, the words "include", "including", and "includes" mean including, but not limited to.

DETAILED DESCRIPTION OF EMBODIMENTS

Embodiments of the present invention provide a method and apparatus for making a filled sachet. The sachet is made of heat sealable, ultrasonically weld-able or other sealable material, and includes content therein. The sachet is customizable for a variety of uses. For example, sachets made with a porous, mesh-structured, or similar material and including tea leaves are useful as tea bags. Sachets made with a porous mesh-structured, or similar materials and including scented material such as a potpourri are useful as infusers in a closet, drawers or rooms. Sachets made with porous mesh-structured, or similar material and including spices are useful in cooking. Sachets made with non-porous material and including condiments or spices are useful in preserving the freshness of such condiments and spices.

The sachet is made, for example, for personal use by a user of the apparatus, and the contents, quantity, size of sachet, material that sachet is made of can be customized by the user. Embodiments include a generally tubular shaped heat sealable material, also referred to as a sock, sealed at one end, and open at another. The content to be included in the sachet is added to the sock such that the added content accumulates near the sealed end of the sock, generally referred to as an end portion of the sock. The content is measured, for example, by using a spoon, or by using a dosing mechanism provided herein, and the content is delivered into the end portion of the sock, for example, using a downtube. The sealed end of the sock is then sealed at a first position such that the content is included between the sealed end of the sock and the first position. The first position is sealed by pinching and heating or ultrasonically welding the sock material across the cross section of the first position, for example, using a heat sealer or an ultrasonic welder to form a thermal bond across the sock. The sealed end of the sock, along with the first seal position and the content included therein, forms the sachet. The sachet is separated from the rest of the sock, for example, using a separator, which separates the sachet by heating or cutting the sock material at a separation position. In some embodiments, the sock is also sealed at a second position extraneous to the sachet, such that the separation position lies in between the first position and the second position. The second position becomes the new sealed end of the sock and the technique as described above may be iterated to yield another sachet.

According to some embodiments, the content is supplied to the dosing mechanism using a hopper, and the dosing mechanism releases a predetermined measure of the content into a downtube. The sock is worn (or mounted) on the downtube such that the sealed end of the sock overhangs from the downtube. The length of the overhang portion is pre-configured or can be adjusted manually to create a desired sachet size. According to some embodiments, the sachet includes additional sachet material for forming a tether on the sachet. The tether is formed using the sachet material, and the tether is cut into the additional sachet material by heat or shear mechanisms. According to some embodiments, the apparatus is modular, that is, the apparatus is configured as multiple modules. For example, the modules include a module for delivering the content for the sachet, a module for making the sachet, and a module for dispensing the sachet. Several other modular configurations will occur readily to those skilled in the art without departing from the scope and spirit of the present invention. The module for delivering content includes, for example, a hopper and a lid. The module for making a sachet includes a downtube to deliver content into a mounted sock of sachet material, and a sealer and separator for sealing and separating a sachet from the sock. In some embodiments, the module for making the sachet also includes a dosing mechanism to measure and dispense a predetermined quantity of the content, for delivery into the sock. The module for dispensing the sachet includes, for example, a slide to receive the sachet separated from the sock and present the sachet to a user of the apparatus, such that the sachet is easy for the user to access. In some embodiments, the module for dispensing the sachet includes a cavity for holding a container, such as a jar, a jug or a mug and the like, to release the sachet(s) directly in to such container(s).

Figure 2:
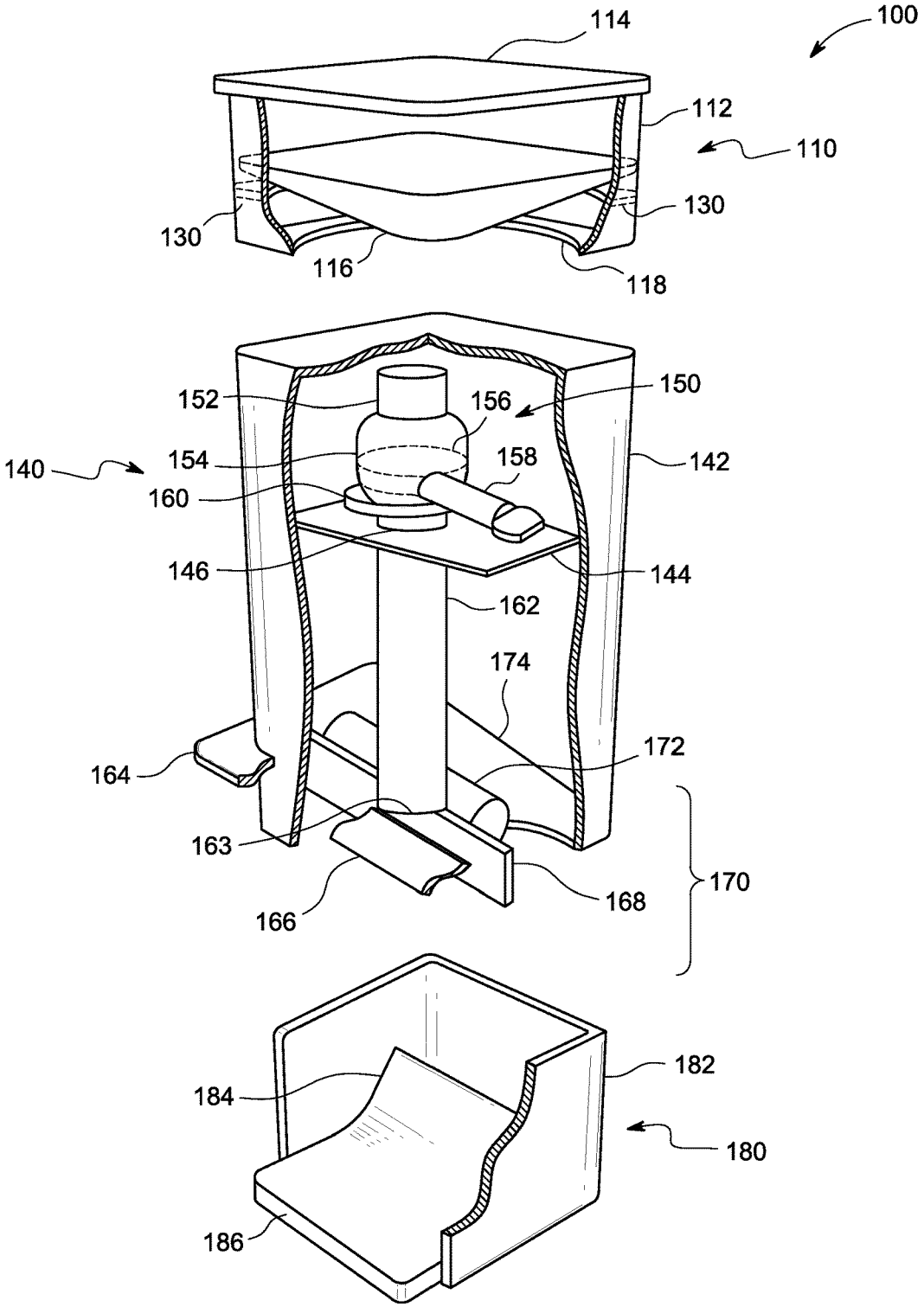
FIG. 2 depicts an exploded and partial cut-away view of the apparatus of FIG. 1, according to one or more embodiments.

FIG. 1 depicts a perspective view of an apparatus 100 for making a filled sachet, according to one or more embodiments. FIG. 2 depicts an exploded and partial cut-away view of the apparatus 100 of FIG. 1. The apparatus 100 includes a content input module (CIM) 110, a sachet maker module (SMM) 140 and a sachet dispense module (SDM) 180. The sachet maker module (SMM) 140 is mounted over the sachet dispense module (SDM) 180, and the content input module (CIM) 110 is mounted over the sachet maker module (SMM) 140.

The content input module (CIM) 110 includes a CIM frame 112, a lid 114, a hopper 116, a CIM base 118, and hopper mounts 130. The lid 114 rests on the CIM frame 112, and the hopper 116 rests on the CIM base 118. In such embodiments, the hopper mounts 130 are optional. In some embodiments, the hopper 116 rests on the one or more hopper mounts 130 projecting inwards from the CIM frame 112 to restrict the downward movement of the hopper 116. In such embodiments, the CIM base 118 is optional. Further, such mounts may be included throughout the apparatus 100 as desired. Even though such mounts may not be explicitly discussed herein or described in the drawings, inclusion of such mounts will occur readily to those of ordinary skill in the art as and where required or advantageous according to the various embodiments described herein. The hopper 116 is usable for convenient receiving of the content to be contained in a sachet, for example, for receiving content poured from a packaged carton (not shown) into the hopper 116.

The sachet maker module (SMM) 140 includes a SMM frame 142, a mount 144, a dosing mechanism 150, a neck plate 160, a downtube 162, a sealing and separating unit 170 and a base 174. The dosing mechanism 150 includes a receiver 152, a portion creator 154, a receiving plate 156 rigidly coupled to a knob 158. The dosing mechanism 150 is connected to the downtube 162, and the portion creator 154 opens into the downtube 162. The mount 144 is a rigidly extending surface from the SMM frame 142, having an opening 146. The cross section of the downtube 162 is smaller than the opening 146, to allow the downtube 162 to go through the opening 146. The neck plate 160 has a larger cross section than the opening 146. The neckplate 160 is rigidly coupled with the dosing mechanism 150, and rests on the mount 144, and thereby restrains a downward movement of the dosing mechanism 150. The sealing and separating unit 170 is mounted (mounts not shown) on the SMM frame 142, positioned proximate to, and downward from a distal end 163 of the downtube 162. The sealing and separating unit 170 comprises a heating module 172, a backplate 168 mounted on the SMM frame 142 and thermodynamically coupled with the heating module 172, and a frontplate 166 (shown partially) mounted on the SMM frame 142 and rigidly connected (connections not shown) to a lever 164 external to the SMM frame 142, such that a downward motion of the lever 164 causes the frontplate 166 to press against the backplate 168.

The sealing and separating unit 170 comprise a sealer and a separator, not shown separately in FIG. 2. According to some embodiments, the sealer and the separator are configured from the components of the sealing and separating unit 170. The sealer seals the sock at one or more points, for example to seal a part of the sock to make a sachet. In some embodiments, the sealer is a heat sealer or an ultrasonic welder. In some other embodiments, the sealer is a staple sealer that deploys thermoplastic or metallic staple pins to seal a portion of a sock. The separator separates a part of the sock from the remaining sock, for example to separate a sealed part of the sock as a sachet. According to some embodiments, the separator is a heat cutter that is the separator cuts a material by heating the material to be cut. According to some other embodiments, the separator is a blade cutter, or a shearing mechanism. Some embodiments of the sealer and the separator are discussed further with reference to FIG. 6.

The sachet dispense module (SDM) 180 comprises a SDM frame 182, a dispense slide 184 and a SDM front edge 186. The dispense slide 184 is curved downward to allow an object (sachet) to slide down the surface of the dispense slide 184 towards the front edge 186.

In one embodiment, the various modules 110, 140 and 180 are removable and replaceable, that is, each module can be removed or replaced individually. The modules employ any one or more of known removable assembling mechanisms for removable assembly within the apparatus 100. The removable assembling mechanisms include, without limitation, fasteners such as screws, clips, snap-fit structures, fabric hook and loop fasteners (e.g. VELCRO®), and similar mechanical means. Modules may be removed for replacing parts within a module, for cleaning, for replacing entire modules, and the like. Parts are replaced to change configuration of the apparatus, e.g. changing to a larger sized downtube or a larger sock, for making a larger sachet. The apparatus 100 is generally made from molded thermoplastics, although some other materials as generally known in the art may also be used. According to several embodiments, the apparatus 100 is suited for use in domestic environments, for example, a home or an office kitchen. In some embodiments, the apparatus 100 has dimensions equal to or less than about 36 centimeters (about 14 inches) high, about 25 centimeters (about 10 inches) deep and about 20 centimeters (about 8 inches) wide.

Figure 3:
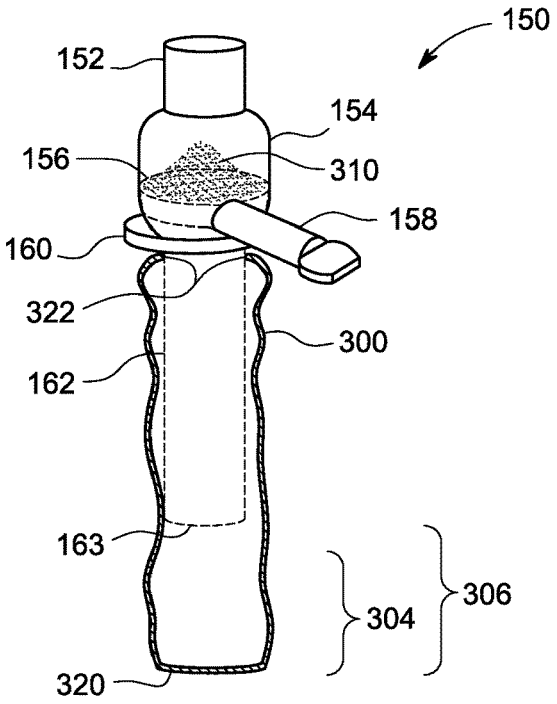
FIG. 3 depicts a dosing mechanism and a downtube of the apparatus of FIG. 2 and a sock mounted on the downtube, the dosing mechanism in a first configuration, according to one or more embodiments.

FIG. 3 depicts the dosing mechanism 150 and the downtube 162 of the apparatus 100 of FIG. 2 and a sock 300 mounted on the downtube 162, the dosing mechanism 150 in a first configuration, according to one or more embodiments. The sock 300 is a general tubular, flexible article having a sealed end and an open end. The sock is made of a porous or non-porous material according to desired sachet application. According to some embodiments, the sock material is a heat sealable material, or the sock material includes a heat sealable inner lining. According to several embodiments of the present invention, the sock is sealed and separated to create multiple sachets. For example, for making a tea-bag sachet, a porous paper sock, lined by a heat sealing material on the inside is used. In some embodiments, the sock is a porous woven or non-woven polyester mesh filter having an inner lining of a heat sealing material, or made from a heat sealing material. For example, a woven polyester mesh filter sock TEAROAD 5100® is available from YAMANAKA IND. CO. LTD. of Japan. YAMANAKA IND. CO. LTD. also makes a non-woven polyester material suitable for use in accordance with some embodiments of the present invention. Non-porous sock materials include without limitation, Polyethylene (PE), which is available widely, and similar other well-known thermoplastic packaging materials.

The sock 300 is mounted over the downtube 162 such that a sealed end 320 of the sock 300 overhangs the downtube 162, while an open end 322 of the sock 300 rests along the length of the downtube 162. In some embodiments, the open end 322 is pinched in between the portion creator 154 and the neckplate 160 near the opening 146. In some embodiments, the friction between the sock 300 and the downtube 162 surface prevents the sock 300 from sliding off the downtube 162. In some embodiments, the surface of the downtube 162 has one or more of a rough or a contoured surface, to prevent the sock 300 from sliding off the downtube 162 due to gravity. In such embodiments, the downtube 162 surface texture and contours creates a bias for the sock 300 to be retained on the downtube 162, unless moved down by a user of the apparatus. An overhang portion 306 of the sock 300 overhangs a distal edge 163 of the downtube 162. The overhang portion 306 includes a sachet portion 304, and the sock 300 is sealed at the sealed end or a distal edge 320 of the sock 300. The overhang portion 306 is generally within an end portion of the sock 300. The receiving plate 156 defines a predetermined volume within the portion creator 154. The receiving plate 156 is rigidly coupled to the knob 158. In the first configuration, the dosing mechanism 150 creates a measured portion of content 310 for delivery to the sock 300, for example, through the downtube 162. The content 310 is received in the portion creator 154 from the hopper 116 of FIG. 2, via the receiver 152. The receiving plate 156 receives the content 310 and is horizontal in the first configuration, to prevent any content 310 received in the portion creator 154 from falling into the downtube 162.

Figure 4:
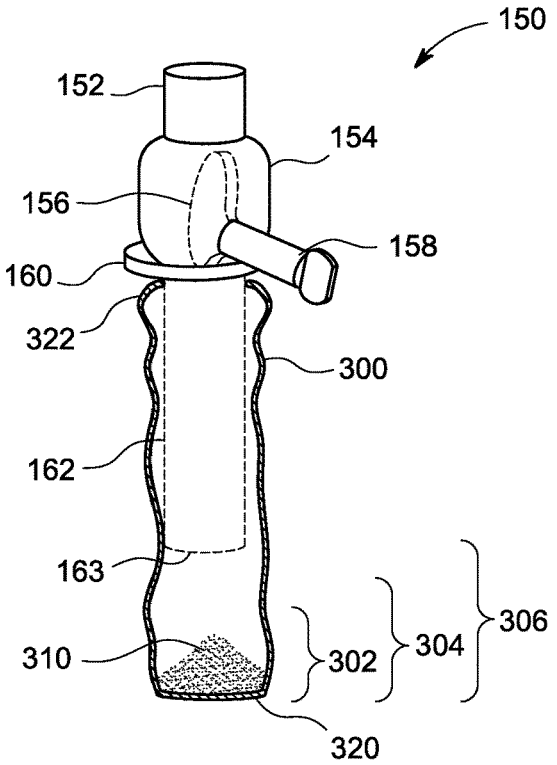
FIG. 4 depicts the dosing mechanism of the apparatus of FIG. 3 in a second configuration, according to one or more embodiments.

FIG. 4 depicts the dosing mechanism of the apparatus of FIG. 2 in a second configuration, according to one or more embodiments. In the second configuration, the receiving plate 156 is vertical, which is achieved for example, by turning the knob 158 by 90 degrees in either direction. The vertical orientation of the backplate 156 causes the content 310 to fall from the portion creator 154 into the downtube 162, which guides the content 310 to be delivered into a content portion 302 of the sock 300. The content 310 rests above the sealed distal edge 320. In some embodiments, the content is directly input into the downtube 162 for delivery in to the sock 300.

Figure 5:
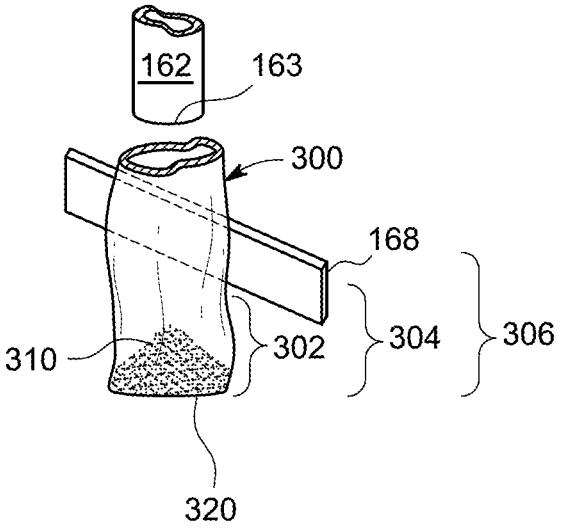
FIG. 5 depicts an overhang portion of a sock of FIG. 3 over a backplate, according to one or more embodiments.
Figure 6:
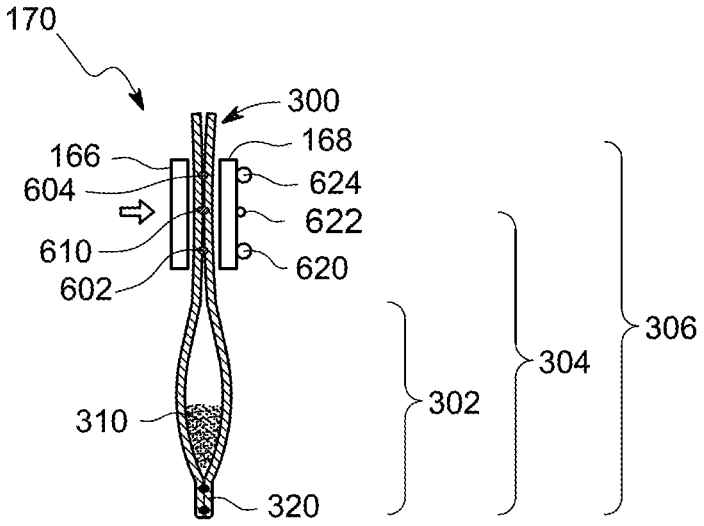
FIG. 6 depicts a side view of the overhanging portion of a sock, according to one or more embodiments.

FIG. 5 depicts the overhang portion 306 of the sock over the backplate 168, according to one or more embodiments. The content 310 is contained in the content portion 302 above the distal edge 320. The sachet portion 304 extends over the backplate 168, while the overhang portion 306 extends proximate the distal end 163 of the downtube 162. FIG. 6 depicts a side view of the overhanging portion 306 of the sock 300, according to one or more embodiments. The cross section of the sock 300 is pinched between the backplate 168 and the frontplate 166. The backplate 168 is heated at particular profiles which include, without limitation, different shapes, having varying lengths, surface areas, and the like. The heating profiles are created by, for example, heating wires 620, 622, and 624 in thermal contact with the backplate 168. The heating wires 620, 622 and 624 correspond to a first seal position 602, a separation position 610, and a second seal position 604, respectively. According to some embodiments, the backplate 168 is about 12 centimeters (5 inches) high, about 20 centimeters (8 inches) wide, and about 1.75 centimeters (0.75 inch) thick, and the backplate 168 is made of heat conductive materials, such as metallic or non-metallic materials, including one or more of high temperature nylon, iron, aluminum, copper, and the like. The frontplate 166 is approximately the same size as the backplate 168, and the frontplate 166 is made of materials comprising, metals or thermoplastics and the like. According to some embodiments, the wires 620, 622, 624 have a diameter from about 0.2 millimeter (about 0.007 inch) to about 0.5 millimeter (about 0.02 inch), and the wires are made of high resistance conductive material, including one or more of iron, nickel, chromium, copper and the like, such as Nichrome, among others. For example, Nichrome wires are available from OMEGA ENGINEERING INC. of Stamford, Conn. According to some embodiments, the wires 620, 622 and 624 are flat wires having a rectangular cross section, and create a broader sealing zone than the circular wires.

In operation, the frontplate 166 is pressed against the backplate 168 as indicated by the arrow in FIG. 6, for example at a pressure from about 1.5 kilograms (3 pounds) to about 2.5 kilograms (5 pounds). The sock 300 is pinched between the frontplate 166 and the backplate 168. The heating wires 620, 622, 624 are heated using the heating module 172 of FIG. 2. According to some embodiments, the sealer described with reference to FIG. 2 includes the wires 620 and 624 corresponding to the first sealing position 602 and the second sealing position 604, the heating module 172, the backplate 168, the frontplate 166, and the lever 164. The wires 620 and 624 are heated to a temperature of about 200 degrees Celsius (about 400 degrees Fahrenheit) to about 310 degrees Celsius (about 600 degrees Fahrenheit) for about 5 to about 8 seconds to cause sealing at the first and the second sealing positions 602, 604. The sealing occurs due to high temperature and pressure achieved at the first and the second sealing positions 602, 604 of the sock 300. Further, while wires with small circular cross sections are illustrated, suitably dimensioned heating wires (not shown) can be used to create a bigger area of a seal. For example, a suitably dimensioned flat wire (not shown) heat seals the region between the first sealing position 602 and the separation position 610, and between the separation position 610 and the second sealing position 604. According to some embodiments, the separator described with reference to FIG. 2 includes the wire 622 corresponding to the separation position 610, the heating module 172, the backplate 168, the frontplate 166, and the lever 164. The wire 622 is heated to a temperature of about 200 degrees Celsius (400 degrees Fahrenheit) to about 310 degrees Celsius (600 degrees Fahrenheit) for about 5 to about 8 seconds to cut the sock 300 at the separation position 610. The separation of the sock occurs due to high temperature and pressure achieved at the separation position 610 of the sock 300. While specific examples have been discussed with respect to the temperatures achieved for heat sealing and heat cutting, and the associated time duration, those skilled in the art will readily appreciate that a variety of temperatures, pressures, time duration, and wire types may be deployed for heat sealing and heat cutting, within the scope and spirit of the present invention.

Once the sock 300 is cut to separate the sachet from the remaining sock 300, the frontplate 166 is pulled back or released from being pressed against the backplate 168, for example, by pulling the lever 164 of FIG. 2 in an upwards direction. After cutting of the sachet from the sock 300, the sock 300 has a new sealed end or a distal edge at the second seal position 604. The cutting of the sachet portion 304 creates a sachet sealed at the distal edge 320 and at the first sealing position 602.

In some embodiments, the sealer comprises a stapling mechanism (not shown) deploying thermoplastic or metallic staples to seal the sock at sealing positions 602 and 604. In some embodiments, the sealer comprises an ultrasonic welding mechanism (not shown) focused to weld an ultrasonic weld-able sock material at the positions 602 and 604. Ultrasonic welding utilizes high-frequency sound waves and pressure to bond the ultrasonic weld-able sock material at positions 602 and 604. In such embodiments that use the alternative sealing mechanisms, such as a stapling mechanism, an ultrasonic welding mechanism or other sealing mechanisms well known in the art, wires 620 and 624 are not included. Further, where required, such embodiments include sock material corresponding to the sealing mechanism used. In some embodiments, the separator is a shearing or a cutting mechanism (not shown) incorporated to cut the sock 300 at the separation position 610. In such embodiments, for example, the wire 622 is not included.

Figure 7:
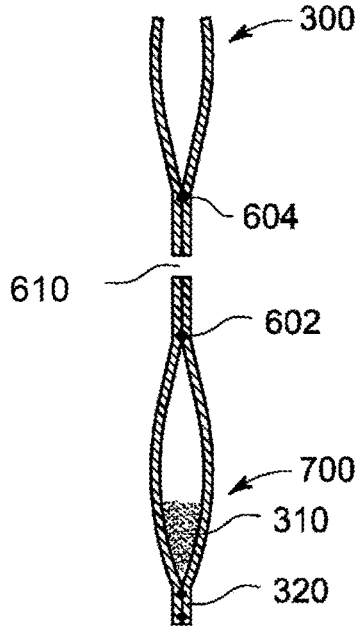
FIG. 7 depicts a side view of sachet separated from a sock, according to one or more embodiments.
Figure 8:
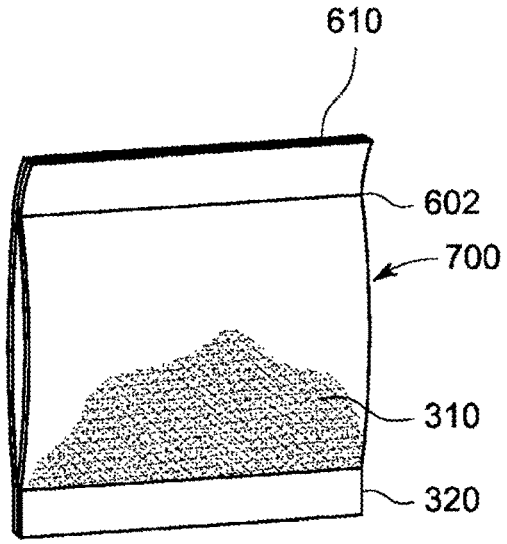
FIG. 8 depicts a front view of a sachet made by the apparatus of FIG. 1, according to one or more embodiments.

FIG. 7 depicts a side view of a sachet 700 separated from the sock 300, according to one or more embodiments. The sachet 700 is separate from the sock 300 at the separation position 610, above the first sealing position 602 at which the sachet 700 is sealed. The distal edge 320 illustrates a position where the sock 300 is sealed, and movement of the content 310 is restricted between the distal edge 320 and the first sealing position 602. FIG. 8 depicts a front view of the sachet 700 made by the apparatus 100 of FIG. 1, according to one or more embodiments. According to some embodiments, the sachet 700 has dimensions of a height of about 1 centimeter (0.4 inch) to about 15 centimeters (6 inches), and a width of about 1 centimeter (0.4 inch) to about 15 centimeters (6 inches). In some embodiments the sachet has a height of about 3 centimeters (1.2 inches), and a width of about 2.5 centimeters (1 inch) for application as a beverage sachet such as tea bag. In some embodiments, the sachet has a height of about 7.5 centimeters (3 inches) and a width of about 5 centimeters (2 inches), for application as a perfume diffuser, for example.

As described with reference to FIGS. 2-8, the dosing mechanism 150 releases the content 310 into the sachet portion of the sock 304, which includes an end portion of the sock 300. The sealer, positioned proximate to the dosing mechanism 150 seals the overhang portion 306 at the firsts seal position 602, confining the content 310 between the end portion of the sock 300 and the first seal position 602. The separator, also positioned proximate to the dosing mechanism 150, separates the sealed portion of the sock from the remaining sock 300, to make the sachet 700 with the content 310. According to some embodiments, the downtube 162 is coupled to the dosing mechanism 150 to guide the content 310 to the sachet portion of the sock 304.

Figure 9:
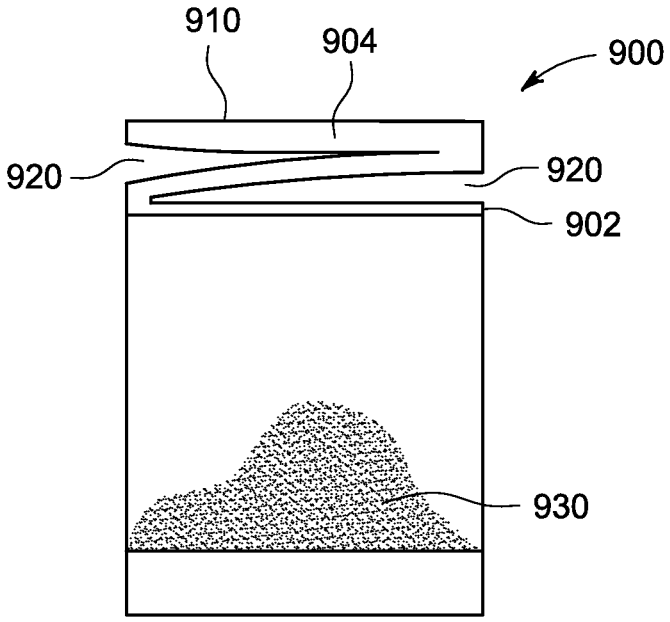
FIG. 9 depicts a sachet having a tether, according to one or more embodiments.

FIG. 9 depicts a sachet 900 having a tether 904, according to one or more embodiments. The tether 904 is useful in lifting and carrying the sachet 900 from one place to another, for example, from storage to a beverage container or to lift the sachet 900 for disposal, and avoids the requirement of adding a thread tether to the sachet 900. The tether 904 is formed by forming or cutting a tether pattern on the sachet (or sock) material above a seal 902, that is, a sealed portion of the sachet. The sock material between the seal 902 and a separation position (sachet top edge) 910 is sealed, and is cut in a "Z" shaped tether pattern as illustrated by the numeral 920. Therefore, the tether pattern does not break the seal 902, and stays extraneous to the seal 902. The tethering cut 920 allows the flexible sachet material above the seal 902 to become extensible, forming the tether 904. According to some embodiments, the tether 904 forms a band having a width between about 2 millimeters (about $1/10^{th}$ of an inch) to about 3 millimeters (about $1/8^{th}$ of an inch).

Figure 10:
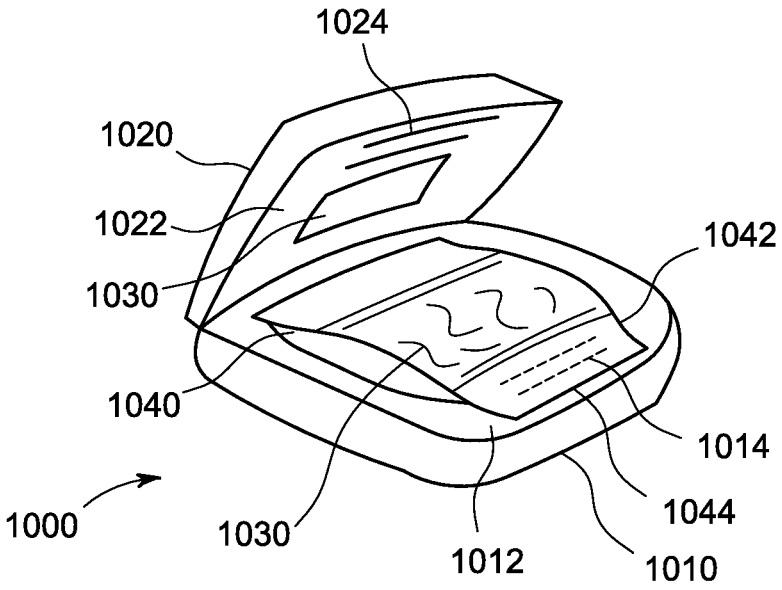
FIG. 10 depicts a tether maker, according to one or more embodiments.

FIG. 10 depicts a tether maker 1000, according to one or more embodiments. The tether maker 1000 forms a tether pattern in a sachet 1040 by cutting at least a portion of the sachet extraneous to one or more seals of the sachet 1040. The tether maker 1000 includes a base 1010, a lid 1020, and a cavity 1030 to hold the sachet 1040. The base 1010 includes an edge 1012, and the lid 1020 includes a corresponding edge 1022. The edge 1012 includes tethering marks 1014, and the edge 1022 includes tethering marks 1024 to create a tethering cut on the sachet 1040. The sachet 1040 comprises a top edge 1042 and a top sealed edge 1044. The sachet 1040 is positioned in the tether maker 1000 such that the region between top edge 1042 and top sealed edge 1044 rests to overlap with one or more of the tethering marks 1014 and 1024. The tethering marks 1014 and 1024 cut the sachet material by one or more of heat or shearing action. For heat cutting, one or more of the tethering marks 1014 and 1024 are heated by a heating mechanism (not shown). For shear cutting, the tethering marks 1014 and 1024 include sharp edges (not shown), that mate to cause a shearing action on an object therebetween. In some embodiments, the tether maker 1000 includes only one of the tethering marks 1014 or 1024. In some embodiments, the tether maker 1000 is incorporated into the sachet maker apparatus 100, in the sachet dispense module 180, for example.

According to some embodiments, the sealing and separating unit 170 comprises additional heating wires (not shown) behind the backplate 168. The additional heating wires create a heating profile on the backplate 168 corresponding to the required tether marks. The additional heating wires are connected to the heating module 172 for being heated, for examples to temperatures of about 250 Fahrenheit to about 300 Fahrenheit. The heated profiles create heat cut tether patterns on the sachet. The tether patterns are created by heat cutting at least a portion of the sachet extraneous to one or more seals of the sachet. In some embodiments, the tether pattern may be created in a sachet simultaneous to sealing of the first position and the second position. In some other embodiments, the tether pattern may be created after the first position and the second position are sealed. The additional heating wires may be heated in a desired sequence with respect to the sealing and cutting wires 620, 622, and 624, and for suitable time duration, for example, from about 4 to about 8 seconds.

Figure 11:
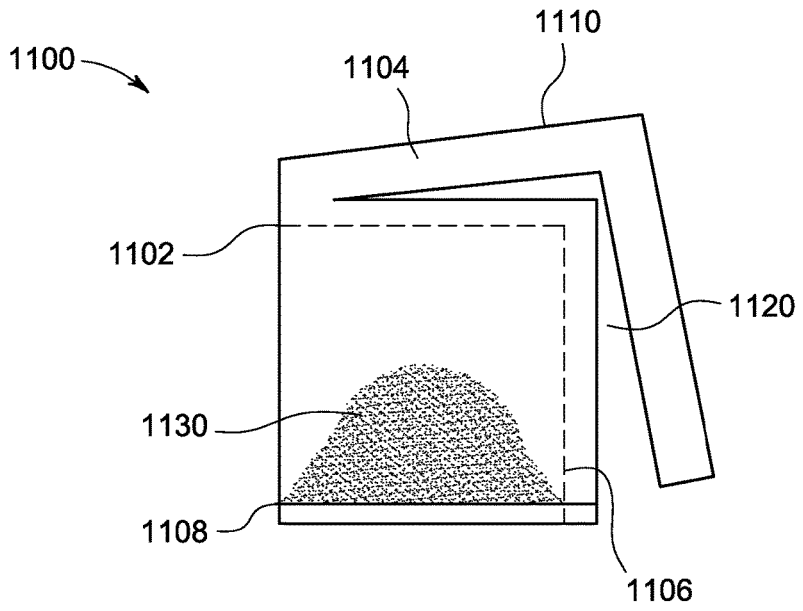
FIG. 11 depicts a sachet having a tether, according to one or more embodiments.

FIG. 11 depicts a sachet 1100 having a tether 1104, according to one or more embodiments. The sachet 1100 includes a top seal 1102, a bottom seal 1108, and a side seal 1106. The side seal 1106 may be formed by a sock having a sealed side edge. In some embodiments, the side seal may be formed using sealing techniques described above. The portion of the sachet material extraneous to the top seal 1102, and the side seal 1106 is cut to form an inverted "L" shaped tether pattern indicated by the numeral 1120 on the sachet 1100. The cut tether pattern 1120 forms the tether 1104 of the sachet material. The tether 1104 is extraneous to the seals 1102, 1106 and 1108, and the tether pattern 1120 does not break or intersect any of the seals 1102, 1106 and 1108. According to some embodiments, the tether 1120 can be made using a tether maker similar to the tether maker 1000 of FIG. 10, or using a corresponding pattern of additional heat cutting wires incorporated behind the backplate 168 of FIG. 6, as also discussed above.

Figure 12:
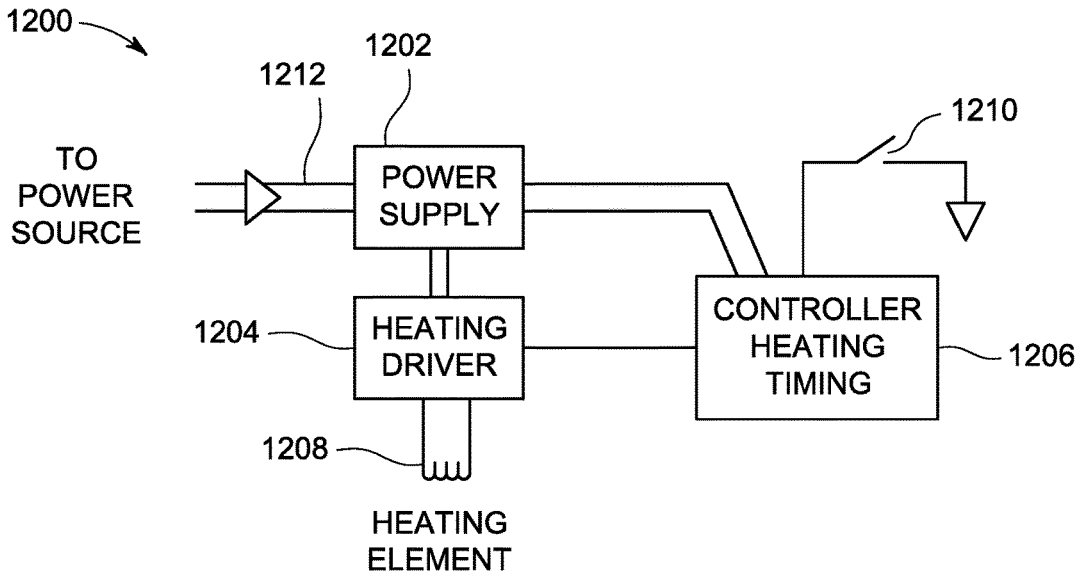
FIG. 12 depicts a schematic representation of heating module, according to one or more embodiments.

FIG. 12 depicts a schematic representation of heating module 1200, according to one or more embodiments. The heating module 1200 is comprised in the heating module 172 of FIG. 2. The heating module 1200 comprises a power supply 1202 coupled to each of a heating driver 1204 and a controller for heating and timing 1206. The heating module 1200 further comprises a heating element 1208 coupled across the heating driver 1204, and a switch 1210 coupled to the controller 1206. The controller 1206 controls the heating driver 1204 to heat the heating element 1208 to desired temperatures, for desired lengths of time. According to some embodiments, the heating element 1208 includes heating wires, for example the wires 620, 622, 624 of FIG. 6, thermally coupled to the backplate 168 of FIG. 6. The power supply 1202 comprises a power cord/plug 1212 that couples to a suitable power source, such as a standard AC electrical outlet found in residential or industrial environments. According to some embodiments, the heating module 1200 employs a low DC voltage power supply, for example, a 5 Volts DC supply. For example, the power supply 1202 draws power from a battery arrangement, or a USB power supply. Several similar obvious heating modules that enable time duration and temperature controlled heating will occur readily to those skilled in the art, and are included within the scope and spirit of the present invention.

Figure 13:
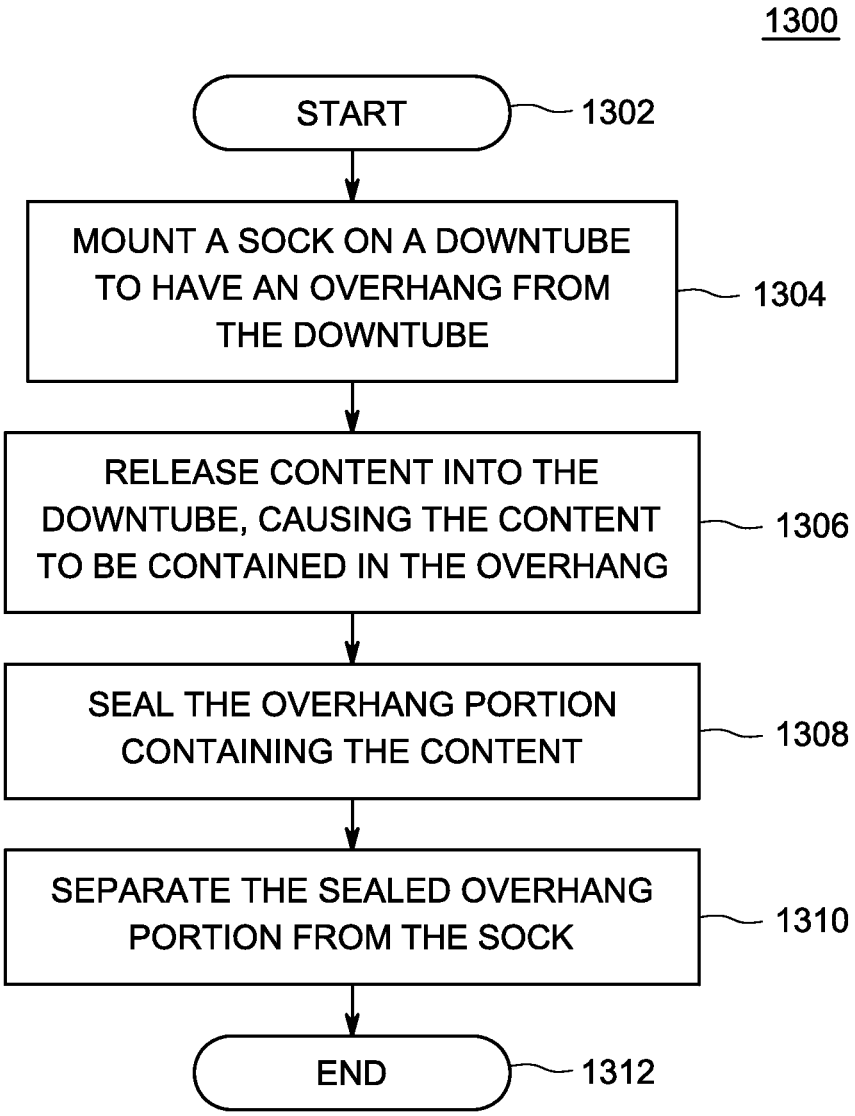
FIG. 13 is a flow diagram of a method for making a filled sachet, according to one or more embodiments.

FIG. 13 is a flow diagram of a method 1300 for making a filled sachet, according to one or more embodiments. The method 1300 starts at step 1302 and proceeds to step 1304 at which a sock is mounted on a downtube to have an overhang from the downtube. The method 1300 proceeds to step 1306, at which content is released into the downtube causing the content to be contained in the overhang portion of the sock. The method 1300 proceeds to step 1308 at which the method 1300 seals the overhang portion containing the content. The method 1300 proceeds to step 1310 at which the method 1300 separates the sealed overhang portion from the sock. The separated overhang portion is a sachet. The method 1300 proceeds to, and ends at step 1312.

According to several embodiments, the downtube is the downtube 162 of FIG. 2, for example, and coupled to a dosing mechanism, for example, the dosing mechanism 150 of FIG. 2, to receive the content for the sachet. According to several embodiments, a user dispenses the content into a downtube directly, that is, without the help of a dosing mechanism, for example, using a spoon or other mechanisms as known in the art.

The apparatus illustrated includes replaceable individual parts that are mounted suitably within the apparatus 100 to perform as described. While each and every structural detail is not described, such details will occur readily to those skilled in the art without departing from the scope and spirit of the present invention. In several embodiments, parts of the apparatus removably fastened to each other, for example by fasteners, screws, and several other known means, and such parts are therefore individually removable. However, in some embodiments, two or more parts may be configured to be non-removably fixed within the apparatus 100. Further, shapes referred to as tubular are not limited to structures with circular cross sections, rather, the term "tubular" additionally includes generally longitudinal hollow structures. Reference to positions or movements, such as up or down, are not meant in a restrictive sense, and obvious variations will occur to those skilled in the art without departing from the scope and spirit of the present invention. Various embodiments of the method and apparatus discussed herein are capable of making sachets for a variety of applications, the sachets including different content, varying dimensions and desired quantities.

All examples described herein are presented in a non-limiting manner. Various modifications and changes may be made as would be obvious to a person skilled in the art having benefit of this disclosure. Realizations in accordance with embodiments have been described in the context of particular embodiments. These embodiments are meant to be illustrative and not limiting. Many variations, modifications, additions, and improvements are possible. Accordingly, plural instances may be provided for components described herein as a single instance. Boundaries between various components, operations and data stores are somewhat arbitrary, and particular operations are illustrated in the context of specific illustrative configurations. Other allocations of functionality are envisioned and may fall within the scope of claims that follow. Finally, structures and functionality presented as discrete components in the example configurations may be implemented as a combined structure or component. These and other variations, modifications, additions, and improvements may fall within the scope of embodiments as defined in the claims that follow.

While the foregoing is directed to embodiments of the present invention, other and further embodiments of the invention may be devised without departing from the basic scope thereof, and the scope thereof is determined by the claims that follow.

The invention claimed is:

1. An apparatus for making a filled sachet comprising:
an input module comprising a hopper;
a sachet maker module comprising a sachet maker; and
a dispensing module comprising a dispensing slide;
wherein the apparatus is about 14 inches or less in height and each module comprises a housing frame and can be removably attached to one another;
the sachet maker comprising:
a downtube, for delivering a content into an end portion of a sock formed from a permeable material;
a sealer, positioned proximate to the downtube, configured to seal the sock at a first seal position to form a sealed portion between the first seal position and the end portion of the sock, and to simultaneously seal the sock at a second seal position contained in a portion of the sock extraneous to the sealed portion, wherein the content is confined in the sealed portion, wherein each activation of the sealer to seal the sock requires a separate respective manual initiation;
a separator positioned proximate to the downtube, configured to separate the sealed portion of the sock from the sock at a separation position between the first seal position and the second seal position;
a dosing mechanism configured to release a predetermined quantity of the content, the dosing mechanism comprising a portion creator comprising a receiving plate physically coupled to and simultaneously rotatable with a knob, the receiving plate and an interior surface of the portion creator defining a predetermined volume within the portion creator when the receiving plate is in a substantially horizontal configuration, wherein rotation of the knob is configured to rotate the receiving plate, and wherein the rotation of the receiving plate to a vertical configuration is configured to release the predetermined quantity of the content into the downtube; and
a receiver located between the hopper and the portion creator, where the receiver has a diameter smaller than that of the portion creator.

2. The apparatus of claim 1, wherein the sealer is a heat-based sealer.

3. The apparatus of claim 2, wherein the separator is a heat-based separator.

4. The apparatus of claim 3, wherein the sealer and the separator are comprised in a single sealer and separator unit.

5. The apparatus of claim 4, wherein the sealer and separator unit further comprises:
a backplate and a frontplate;
a heating module configured to heat at least a portion of the backplate; and
a lever configured to press the frontplate to the backplate,
wherein the backplate and the frontplate are configured to receive the sock therebetween, and
wherein the separate respective manual initiations each comprise manipulating the lever to pinch the sock between the backplate and the frontplate.

6. The apparatus of claim 5, wherein the backplate comprises at least two sealing zones and at least one cutting zone, wherein the at least two sealing zones and the at least one cutting zone each comprises a corresponding wire positioned in thermal contact thereto, each of the corresponding wires thermally coupled to the heating module, and configured to be heated by the heating module.

7. The apparatus of claim 6, wherein the heating module is configured to heat
the at least two sealing zones to a temperature between about 200 degrees Celsius to about 310 degrees Celsius, for a time duration between about 5 seconds to about 8 seconds, and
the at least one cutting zone to a temperature between about 200 degrees Celsius to about 310 degrees Celsius, for a time duration between about 5 seconds to about 8 seconds.

8. The apparatus of claim 7, wherein the sock is made of at least one of a woven or a non-woven mesh filter material, and the sock comprises at least one of a heat sealable inner lining, or an ultrasonically weld-able inner lining.

9. The apparatus of claim 8, wherein the sock is positioned as being worn on the downtube, and a sealed end of the sock overhangs the downtube.

10. The apparatus of claim 1, further comprising the hopper forming a conduit to the dosing mechanism, the hopper configured to allow the content to be transferred from the hopper into the dosing mechanism.

11. The apparatus of claim 1, further comprising a single controller limited to control only the heating of a heating element of the sachet maker.

12. A system comprising the apparatus of claim 1 and a tether maker configured to cut a tether pattern into a sealed portion of the sachet.

13. The system of claim 12, wherein the tether pattern is at least one of an inverted "L" shape, a "Z" shape or an "S" shape.

14. A method for making a filled sachet, comprising:
providing an apparatus, having a height of about 14 inches or less, for making a filled sachet comprising an input module, a sachet maker module, and a dispensing module, and wherein the input module comprises a hopper, the dispensing module comprises a dispensing slide, and the sachet maker module comprises a sachet maker, and wherein each module comprises a housing frame and can be removably attached to one another;
mounting a sock formed from a permeable material on a downtube of the sachet maker to have an overhang from the downtube;
providing a content into a portion creator of a dosing mechanism of the sachet maker, the portion creator comprising a receiving plate in a substantially horizontal configuration within the portion creator, the receiving plate and an interior surface of the portion creator defining a predetermined volume within the portion creator, and the receiving plate physically coupled to and simultaneously rotatable with a knob, wherein the content is provided into the portion creator via a receiver located between the hopper and the portion creator, wherein the receiver has a diameter smaller than that of the portion creator;
rotating the knob to rotate the receiving plate to a substantially vertical configuration, thereby releasing the content into the downtube causing the content to be contained in the overhang portion of the sock;

sealing, by a sealer of the sachet maker, the overhang portion containing the content at a first seal position and a second seal position, wherein each activation of the sealer to seal the sock requires a separate respective manual initiation; and separating, by a separator of the sachet maker, the sealed overhang portion from the sock at a separation position in between the first seal position and the second seal position.

15. The method of claim 14, wherein the sealing comprises at least one of heat sealing the sock, ultrasonically welding the sock, or staple sealing the sock.

16. The method of claim 14, wherein the separating comprises at least one of heat cutting the sock, or shear cutting the sock.

17. The method of claim 14, further comprising forming a tether pattern in the sachet by cutting at least a portion of the sachet extraneous to at least one seal position of the sachet.

18. The method of claim 14, wherein the sachet maker comprises a single controller limited to only control heating of a heating element for performing the sealing.

* * * * *